US007806720B2

(12) United States Patent
Omori et al.

(10) Patent No.: US 7,806,720 B2
(45) Date of Patent: Oct. 5, 2010

(54) WIRE HARNESS AND WIRE HARNESS ASSEMBLING METHOD

(75) Inventors: Yasuo Omori, Yokkaichi (JP); Hiroki Hirai, Yokkaichi (JP); Tetsuji Tanaka, Yokkaichi (JP); Tatsuo Tamagawa, Yokkaichi (JP)

(73) Assignees: Sumitomo Wiring Systems, Ltd., Mie (JP); Autonetworks Technologies, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 12/597,549

(22) PCT Filed: Jan. 13, 2009

(86) PCT No.: PCT/JP2009/050327

§ 371 (c)(1),
(2), (4) Date: Oct. 26, 2009

(87) PCT Pub. No.: WO2009/090942

PCT Pub. Date: Jul. 23, 2009

(65) Prior Publication Data

US 2010/0144193 A1 Jun. 10, 2010

(30) Foreign Application Priority Data

Jan. 17, 2008 (JP) ..... 2008-007891

(51) Int. Cl.
*H01R 31/08* (2006.01)

(52) U.S. Cl. ..... 439/507

(58) Field of Classification Search ..... 439/507, 439/248, 511, 928, 357, 358, 350–352
See application file for complete search history.

(56) References Cited

U.S. PATENT DOCUMENTS 7,351,085 B2 4/2008 Tamagawa et al.

(Continued)

FOREIGN PATENT DOCUMENTS

JP 2000-173352 6/2000

(Continued)

OTHER PUBLICATIONS

English language Abstract of JP 2000-173352, Jun. 23, 2000.

(Continued)

*Primary Examiner*—Jean F Duverne
(74) *Attorney, Agent, or Firm*—Greenblum & Bernstein P.LC.

(57) ABSTRACT

A wire harness has a joint connector having a joint terminal and a connector housing. The joint terminal has a short-circuit section and a plurality of electrical contact portions aligned in a direction substantially orthogonal to an axial direction of wires. The connector housing has an external wall surrounding terminal chambers and exposed to the outside; and a plurality of terminal locking tabs formed integrally with the external wall the terminal locking tabs locking wire terminals. Each of the terminal locking tabs has a shape deflectable between an engaging position that locks each wire terminal and a disengaging position. The joint connector is fixed to the peripheral surface of a wire harness main body while the outer surface of the external wall of the connector housing faces and contacts the peripheral surface of the wire harness main body the connector housing being provided with the terminal locking tabs.

7 Claims, 7 Drawing Sheets

U.S. PATENT DOCUMENTS

| | | | | |
|---|---|---|---|---|
| 7,641,500 | B2 * | 1/2010 | Stoner et al. | 439/357 |
| 7,690,927 | B1 * | 4/2010 | Kerrigan et al. | 439/74 |
| 2006/0205270 | A1 * | 9/2006 | Sakurai et al. | 439/507 |
| 2007/0054547 | A1 * | 3/2007 | Ohtaka et al. | 439/507 |

FOREIGN PATENT DOCUMENTS

| | | |
|---|---|---|
| JP | 2004-14220 | 1/2004 |
| JP | 2005-50794 | 2/2005 |
| JP | 2006-49199 | 2/2006 |

OTHER PUBLICATIONS

English language Abstract of JP 2004-14220, Jan. 15, 2004.
English language Abstract of JP 2006-49199, Feb. 16, 2006.
English language Abstract of JP 2005-50794, Feb. 24, 2005.

* cited by examiner

WIRE HARNESS AND WIRE HARNESS ASSEMBLING METHOD

BACKGROUND OF THE INVENTION

1. Field of the Invention

The present invention relates to a wire harness, in which, in order to form a branch circuit configured with a plurality of wires included in a wire harness main body and for other purposes, a plurality of wire terminals, which are each respectively provided at ends of wires are electrically shorted to one another by a joint connector. The present invention also relates to an assembling method of such a wire harness.

2. Description of Related Art

Related Art 1, for example, discloses such a wire harness, which has a joint connector bound to a peripheral surface of a wire harness main body with tape.

Specifically, the joint connector includes a joint terminal shorting the wire terminals to one another and a connector housing configured to hold the joint terminal and the wire terminals. The connector housing includes a housing main body and a cover. The housing main body has terminal insertion sections to which the wire terminals are inserted and terminal locking tabs on a top wall of the terminal insertion sections, locking the wire terminals inserted into the terminal insertion sections. When the wire terminals are inserted between a bottom wall of the housing main body and the terminal locking tabs, a locked portion provided on a top surface of each of the wire terminals engages with the terminal locking tab, so that the wire terminals are locked in a position in contact with the joint terminal. Each of the wire terminals contacts the joint terminal, and thereby the wire terminals are shorted to one another. The cover covers an entire top surface of the housing main body including the terminal locking tabs, and restricts upward displacement of the terminal locking tabs (i.e., displacement in a direction in which the terminal locking tabs separate from the wire terminals, and unlock the engagement). The joint connector that houses the wire terminals shorted to one another as described above is wrapped around an periphery surface of the wire harness main body with a tape, such that the bottom wall of the housing main body faces the wire harness main body.

In the above-described conventional wire harness, the cover covering the entire top surface of the housing main body is provided to the joint connector, such that the locking force, by which the terminal locking tabs locks the wire terminals, is maintained by restricting displacement of the terminal locking tabs. Therefore, the cover increases the projection amount of the joint connector from the wire harness main body.

[Related Art 1] Japanese Patent Laid-open Publication No. 2005-50794

SUMMARY OF THE INVENTION

The present invention provides a wire harness which can be downsized while maintaining a locking force to lock wire terminals.

In order to resolve the problem, the present invention provides a wire harness that includes a wire harness main body configured with a plurality of wires; and a joint connector electrically shorting a plurality of wire terminals to one another, each of the plurality of wire terminals being respectively provided at ends of the plurality of wires included in the wire harness main body. The joint connector has a joint terminal contacting each of the wire terminals, and thereby shorting the wire terminals to one another; and a connector housing internally housing and holding the joint terminal and each of the wire terminals respectively. The joint terminal configured to contact each of the wire terminals, integrally includes: a plurality of electrical contact portions aligned in a direction substantially orthogonal to an axial direction of the wires connected to the wire terminals; and a short-circuit portion extending in a direction of the alignment of the electrical contact portions, and continuing to each of the electrical contact portions. The connector housing has: an external wall surrounding a terminal chamber configured to house each of the wire terminals, and being exposed outside; and a plurality of terminal locking tabs integrally formed with the external wall, and each locking each of the wire terminals housed in the terminal chamber while maintaining contact with the joint terminal. Each of the terminal locking tabs is configured to deflect between a locking position that locks each of the wire terminals and an unlocking position that unlocks each of the wire terminals, by retracting outward of the external wall from the locking position. The joint connector is fixed onto a peripheral surface of the wire harness main body while an outer surface of the external wall of the connector housing faces and contacts the peripheral surface of the wire harness main body, the connector housing being provided with the terminal locking tabs.

According to the above-described wire harness, compared to a configuration that houses the terminal locking tabs within the terminal chambers surrounded by the external walls, the thickness of the joint connector, i.e., the projection amount from the wire harness main body can be reduced. In addition, the displacement of the terminal locking tabs is restricted by the periphery of the wire harness main body, thereby maintaining the locking force on of the wire terminals.

DETAILED DESCRIPTION OF PREFERRED EMBODIMENT

A preferred embodiment of the present invention will be described hereinafter with reference to the drawings.

Figure 1:
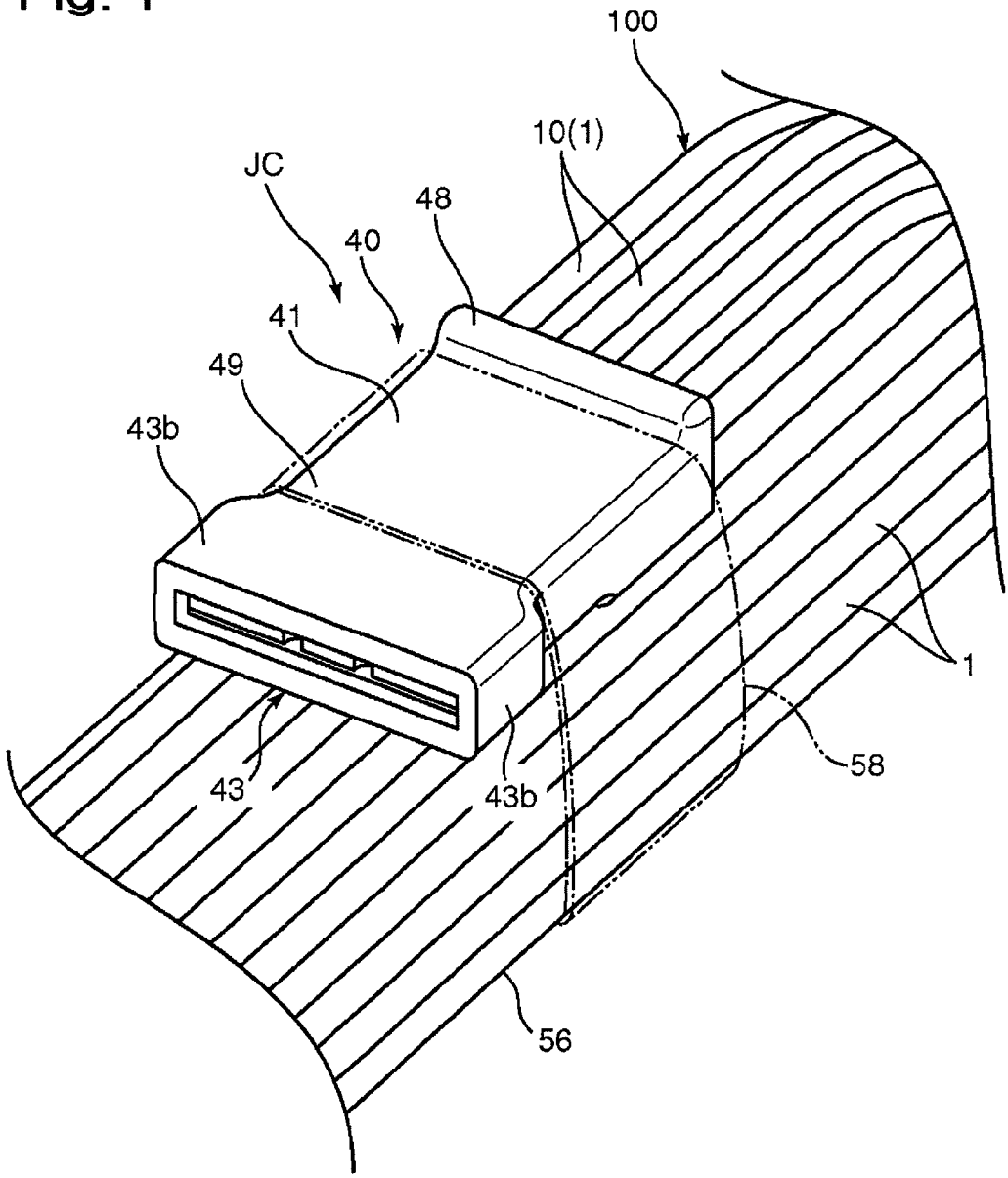
FIG. 1 is a schematic perspective view showing a wire harness according an embodiment of the present invention.
Figure 2:
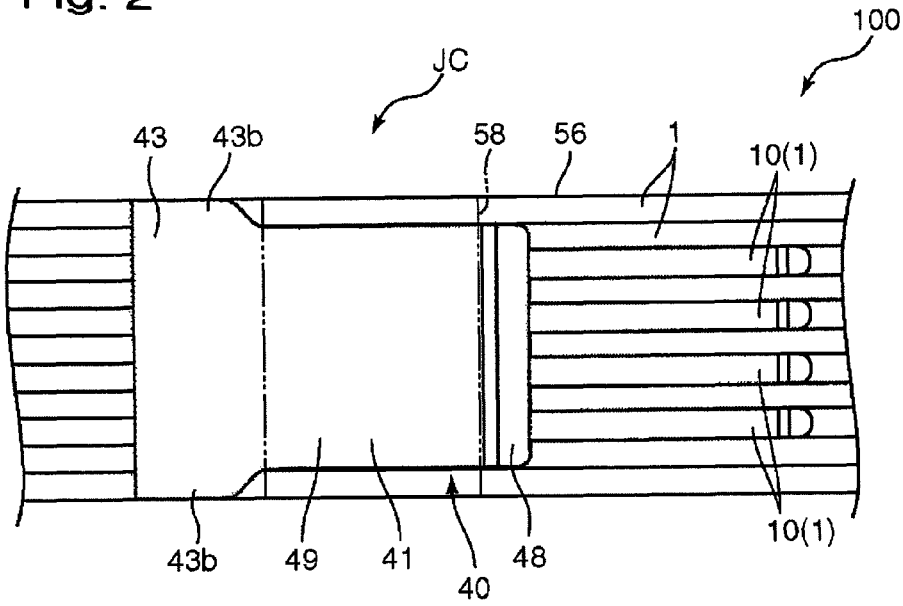
FIG. 2 is a schematic diagram illustrating a plan view of FIG. 1.
Figure 3:
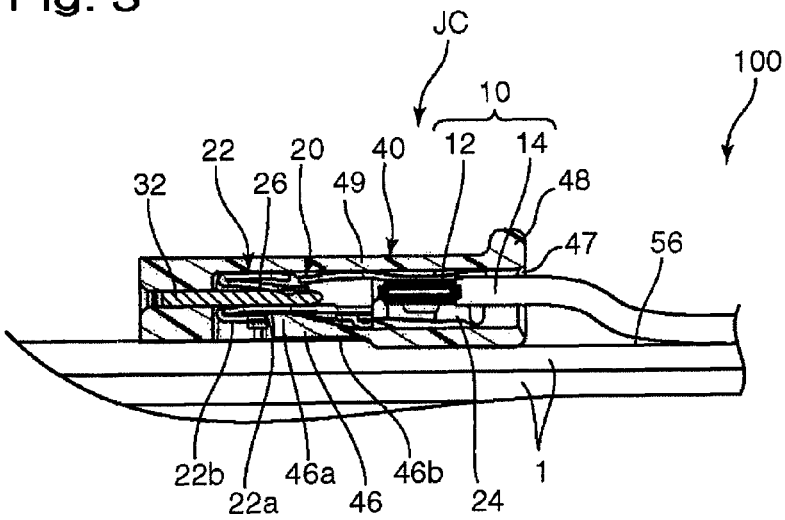
FIG. 3 is a schematic diagram illustrating a cross-sectional view of FIG. 1.
Figure 4:
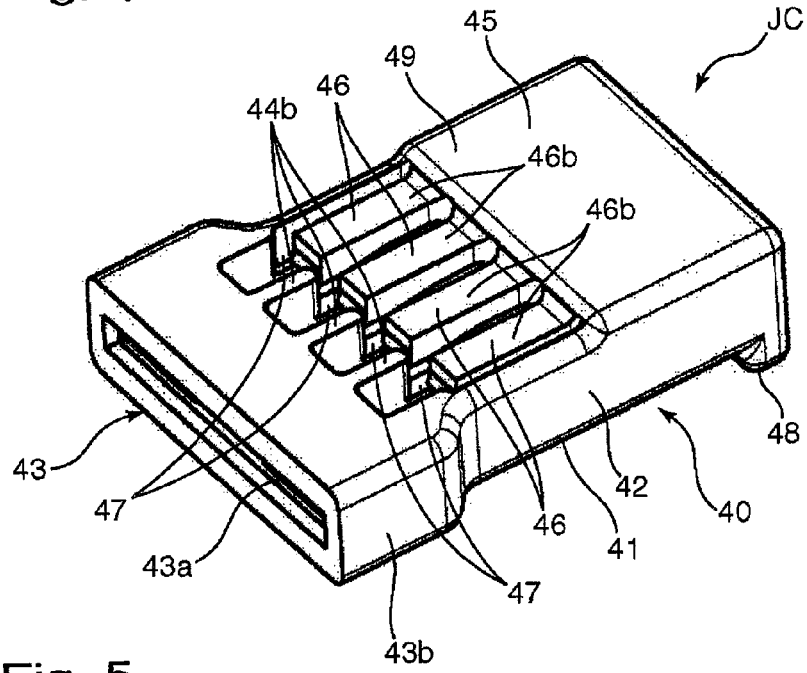
FIG. 4 is a perspective view illustrating a joint connector of FIG. 1.
Figure 5:
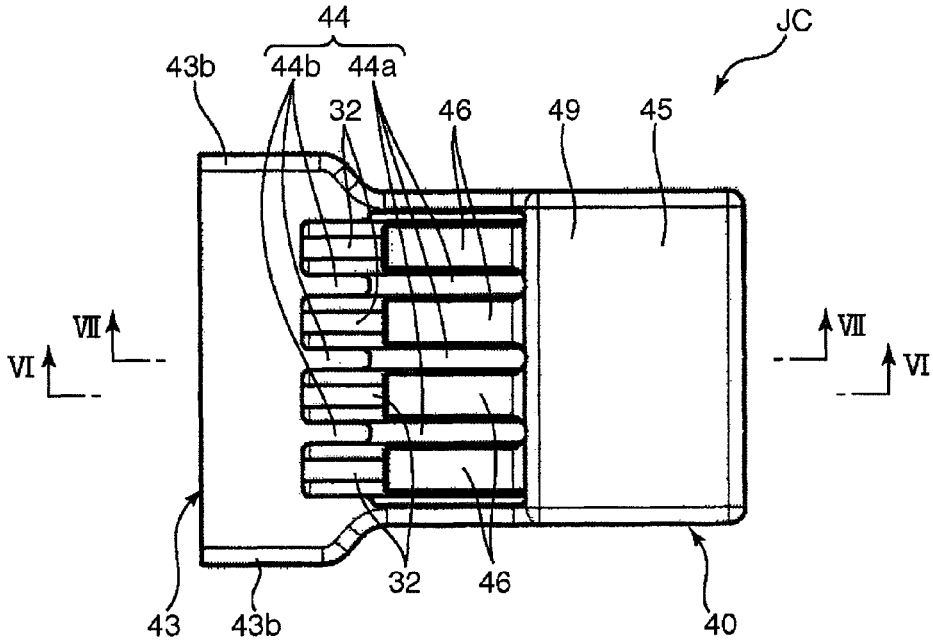
FIG. 5 is a plan view illustrating the joint connector of FIG. 1.
Figure 6:
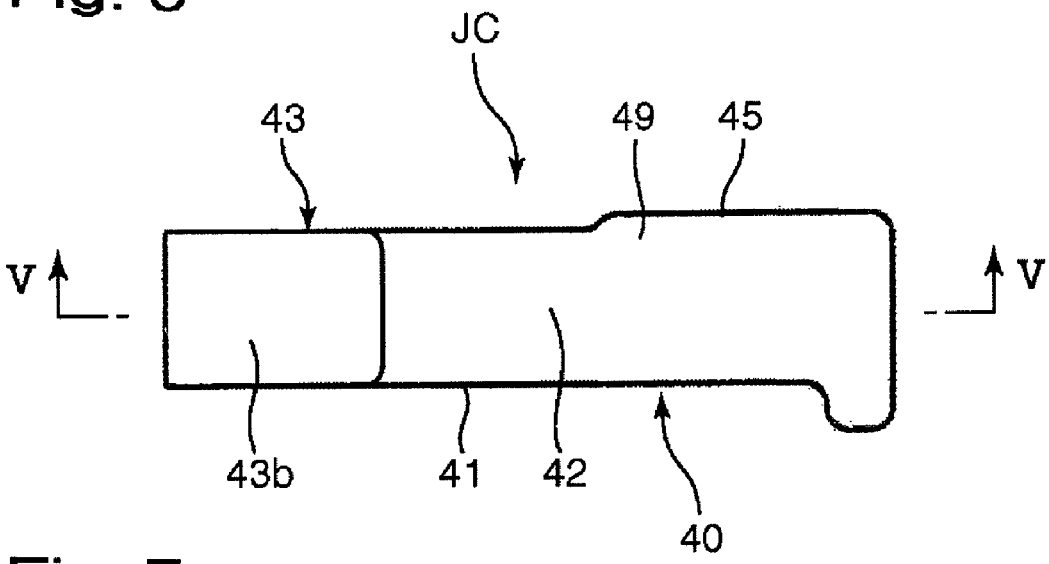
FIG. 6 is a side view illustrating the joint connector of FIG. 1.
Figure 7:
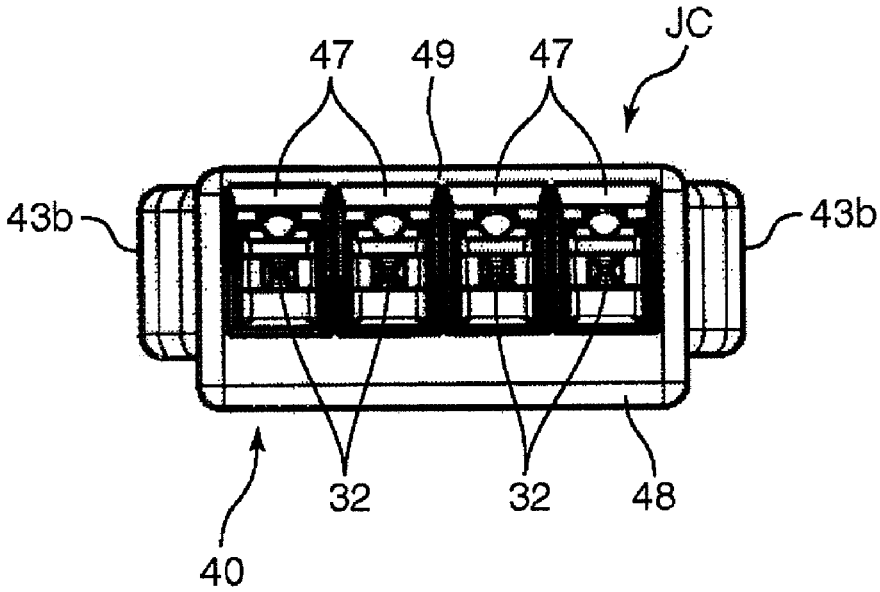
FIG. 7 is a front view of the joint connector of FIG. 1.

FIG. 1 is a schematic perspective view showing a wire harness 100 according an embodiment of the present invention. FIG. 2 is a schematic diagram illustrating a plan view of FIG. 1. FIG. 3 is a schematic diagram illustrating a cross-sectional view of FIG. 1. In the wire harness 100 as shown in FIGS. 1-3, a joint connector JC is bound with a tape 58 to a wire harness main line (a wire harness main body) 56 that is configured with a plurality of wires 1 in a bundle. Wire terminals 20 each respectively provided at ends of a plurality of wires 10 of wires 1 (four wires in the drawings) are shorted to one another by the joint connector JC. FIGS. 4-10 show the joint connector JC.

As shown in FIG. 3, each of the wires 10 includes an electric conductor 12 and an insulating coating 14 that covers the electric conductor 12. A terminal of each insulating coating 14 is removed, and thereby an end of each electric conductor 12 is exposed. The wire terminal 20 is pressure-bonded to the end of the electric conductor 12.

The wire terminal 20 has a female electrical contact portion 22 and a wire pressure-bonding portion 24 in front and rear thereof. The female electrical contact portion 22 has a hollow rectangular tubular main body and a contact spring 26 that has a shape deflectable within the main body of the female electrical contact portion 22. A top wall 22*b* of the main body of the female electrical contact portion 22 (a surface at the lower side in FIG. 3) is provided with a stepped portion 22*a* engaging with a locking portion 46*a* of a connector housing 40, which is to be described later. The wire pressure-bonding portion 24 is pressure-bonded to the electric conductor 12 while embracing the end of the electric conductor 12. Thereby, the wire pressure-bonding portion 24 is electrically connected to the electric conductor 12.

Figure 8:
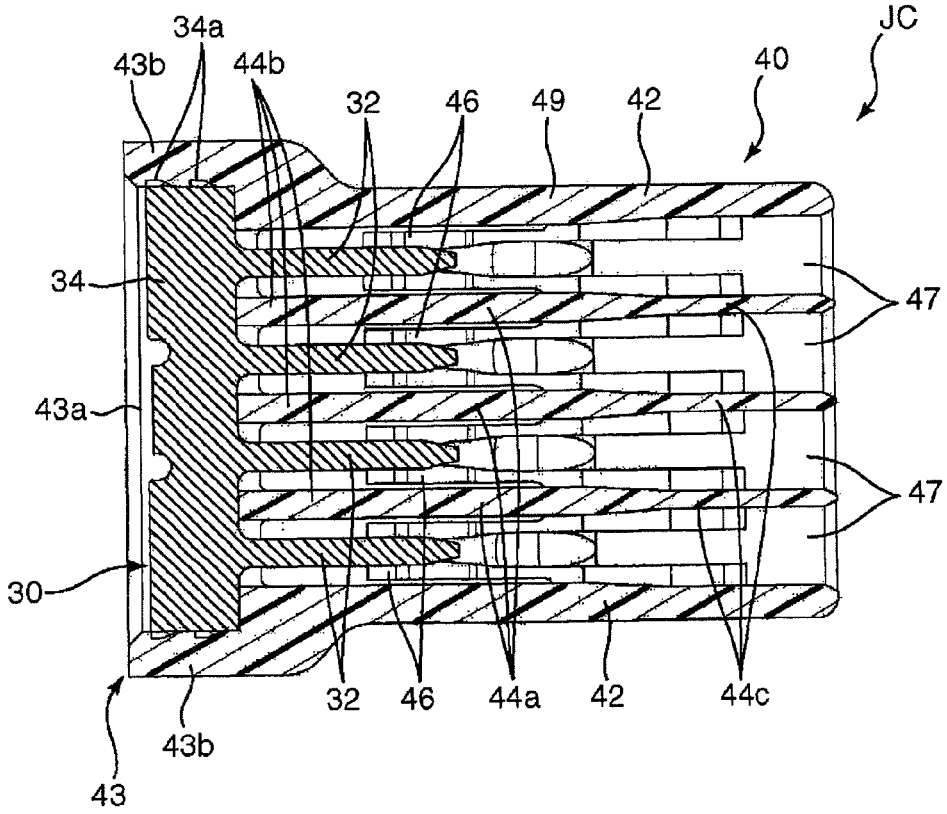
FIG. 8 is a cross-sectional view taken along a line V-V of FIG. 6.

The joint connector JC includes a joint terminal 30 shown in FIG. 8 and the like and the connector housing 40 holding the joint terminal 30. The joint terminal 30, which is configured with a conductive material, is commonly connected to each of the wire terminals 20, and thereby shorts the wire terminals 20 to one another. The connector housing 40 is molded into one piece with an insulating material, such as synthetic resin, and is shaped to house the joint terminal while housing the joint terminal 30 therein.

The joint terminal 30 is configured with a single piece metal plate. Specifically, the joint terminal 30 integrally has a plurality of electrical contact portions 32 and a short circuit portion 34. Each of the electrical contact portions 32 of the joint terminal 30 is a male-molded part (tab) that can be fitted to the female electrical contact portion 22 of each of the wire terminals 20. These male electrical contact portions 32 are aligned in parallel with the width direction thereof. The short-circuit portion 34 extends in the alignment direction of the male electrical contact portions 32, and continues to a base end of each of the electrical contact portions 32.

The connector housing 40 integrally has a planar main body wall 41, right and left side walls 42, a terminal holder 43, a plurality of partition walls 44, an auxiliary wall 45, and a plurality of lances (terminal locking tabs) 46. The right and left side walls 42 lead upward from both ends in the width direction of the main body wall 41. The terminal holder 43 is connected to rear ends (ends at the left in FIGS. 8-10) of the main body wall 41 and the side walls 42. The plurality of partition walls 44 project from the main body wall 41 to the inside of the connector housing. The plurality of lances 46 continue to the auxiliary wall 45. The main body wall 41, the side walls 42, the terminal holder 43, the partition walls 44, the lances 46 are externally exposed at least at one side thereof, and configure external walls 49 of the connector housing 40.

The terminal holder 43 holds the short-circuit portion 34 of the joint terminal 30. The terminal holder 43 is one size larger than the short-circuit portion 34, and has a shape extending in the alignment direction of the male electrical contact portions 32 of the joint terminal 30. The terminal holder 43 surrounds a joint terminal insertion opening 43*a* into which the short-circuit portion 34 can be inserted from behind (from the left in FIG. 8). The short-circuit portion 34 is press-fitted into the terminal holder 43 from the joint terminal insertion opening 43*a* with each of the male electrical contact portions 32 facing the front. Therefore, the short-circuit portion 34 is fixed within the joint terminal insertion opening 43*a*. Projections 34*a* shown in FIG. 8 are provided at both ends in the width direction of the short-circuit portion 34. These projections 34*a* bite into an inner surface of the terminal holder 43, so that the short-circuit portion 34 is fixed within the joint terminal insertion opening 43*a*.

A width of the terminal holder 43 (i.e., a dimension in the alignment direction of the joint terminal 30) is greater than those of other portions so that the terminal holder 43 retains sufficient strength to hold the short-circuit portion 34. In other words, both ends in the width direction of the terminal holder 43 form a first projection 43*b* projecting outward beyond outer surfaces of the right and left side walls 42.

The male electrical contact portions 32 of the joint terminal 30 are aligned in parallel with the width direction of the joint terminal 30. The terminal holder 43 also extends in the alignment direction, and thereby the width of the connector housing 40 can be reduced in a direction orthogonal to the alignment direction.

The partition walls 44 are provided between the mutually abutting electrical contact portions 32, while the joint terminal 30 is held by the terminal holder 43. The partition walls 44 project from an inner surface of the main body wall 41 to the inside of the connecter housing 40 (upward based on the joint connector JC in FIG. 9). The partition walls 44 continuously and linearly extend from the terminal holder 43 to an opposite end (a front end of the connector housing 40).

The mutually abutting partition walls 44 define therebetween terminal chambers 47 into which each of the wire terminals 20 can be inserted, the wire terminals 20 being connected to the male electrical contact portions 32. The terminal chambers 47 have openings at the front end of the connector housing 40 (the opposite end from the terminal holder 43), and the wire terminals 20 are inserted through the openings into the terminal chambers 47.

Figure 9:
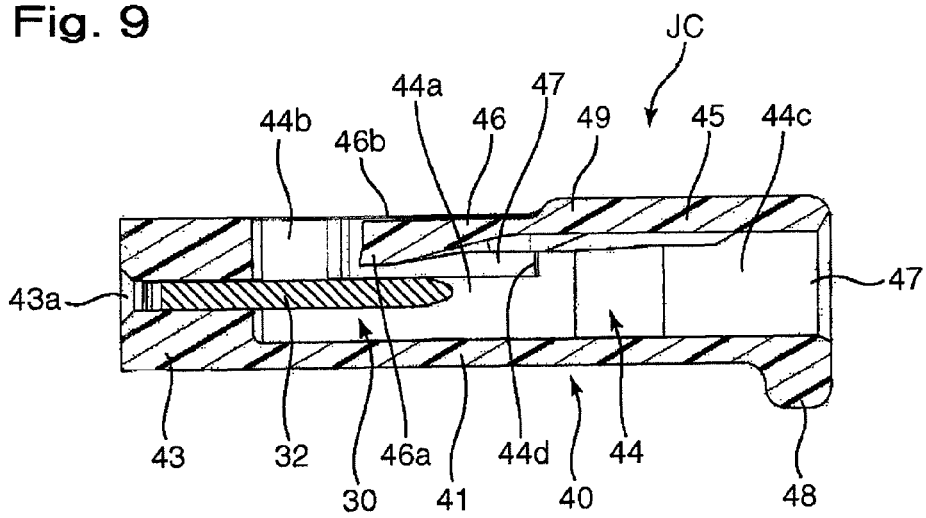
FIG. 9 is a cross-sectional view taken along a line VI-VI of FIG. 5.
Figure 10:
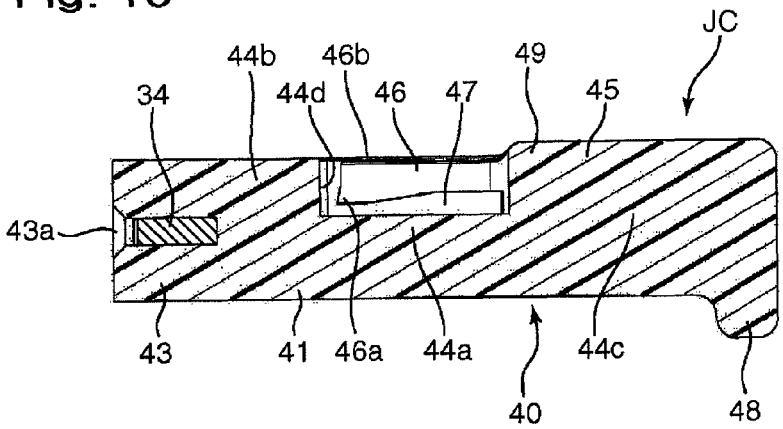
FIG. 10 is a cross-sectional view taken along a line VII-VII of FIG. 5.

As shown in FIGS. 9 and 10, each of the partition walls 44 integrally has a middle wall portion 44*a*, a rear wall portion 44*b*, and a front wall portion 44*c*. The middle wall portion 44*a* stands between the main body wall 41 and the lance 46. The rear wall portion 44*b* stands between a rear end of the lance 46 and the terminal holder 43. The front wall portion 44*c* continues to the auxiliary wall 45 at a position forward of the middle wall portion 44*a*.

The middle wall portion 44*a*, the rear wall portion 44*b*, and the front wall portion 44*c* individually project from the inner surface of the main body wall 41 into inside of the connector housing 40. The middle wall portion 44*a* projects from the main body wall 41 by an amount smaller than the shortest distance from the main body wall 41 to the lance 46. The rear wall portion 44*b* and the front wall portion 44*a* project from the main body wall 41 by an amount greater than the shortest distance. Since the projection amounts from the main body wall 41 are changed accordingly, each of the partition walls 44 is provided with a rectangular notch 44*d* that avoids a region in which the lance 46 is present, when viewed from a direction parallel to the alignment direction of the male electrical contact portions 32.

The auxiliary wall 45 is provided in a front portion (a portion at the opposite end from the terminal holder 43) of the connector housing 40. The auxiliary wall 45 covers each of the terminal chambers 47 from the opposite side (the upper side based on the joint connector JC in FIG. 9 and the like) of the main body wall 41, and continues to each of the side walls 42 and each of the partition walls 44. In other wards, each of the terminal chambers 47 is surrounded by the main body wall 41, the auxiliary wall 45, and the partition walls 44 or the side wall 42 in the all four directions.

Each of the lances 46 engages with the wire terminal 20 that is inserted into the terminal chamber 47 and fitted to the male electrical contact portion 32. Each of the terminal chambers 47 is provided with the lance 46. The lances 46 are integrally formed with the auxiliary wall 45, and extend rearward from the auxiliary wall 45 (toward the terminal holder 43). In addition, the lances 46 are exposed outside, and configure a part of an external wall 49 of the connector housing 40. Specifically, outer surfaces 46*b* of the lances 46 at the opposite side from the main body wall 41 are exposed outside. As described above, in the joint connector JC, each of the lances 46 are integrally formed with the external wall 49 of the connector housing 40, and thereby the width of the connector housing 40 is reduced compared to when the lances 46 are provided inside the terminal chambers 47, such as on an inner surface of the auxiliary wall 45.

Each end of the lances 46 are provided with the locking portion 46*a* that locks the wire terminal 20 by abutting the stepped portion 22*a* provided on the top wall 22*b* of the female electrical contact portion 22 of the wire terminal 20. Each of the locking portions 46*a* has a claw shape that allows the locking portions 46*a* to abut the stepped portions 22*a* from the front side (the right in FIG. 3) of the connector housing 40. By abutting the stepped portions 22*a*, the locking portions 46*a* prevent the wire terminals 20 from disengaging from the connector housing 40. Each end of the lances 46 having the locking portions 46*a* is a deflectable free end, such that the end retracts outward of the main body wall 41 from a locking position to lock the wire terminal 20, and deflects towards an unlocking position (downward in FIG. 3, and upward in FIGS. 9 and 10) to unlock the wire terminal 20.

A second projection 48 is provided at a front end of the main body wall 41. The second projection 48 extends in the alignment direction of the male electrical contact portions 32 of the joint terminal 30, and projects outward. A distance between the second projection 48 and the first projection 43*b* (a distance in a direction in parallel with a direction in which the wire terminals 20 are inserted into the connector housing 40) is substantially the same as a width of the tape 58.

Next, an assembling method of the wire harness 100 is described hereinafter. In the assembling method, each of the wire terminals 20 is shorted by using the joint connector JC, which is configured as described above, and the joint connector JC is fixed onto the wire harness main line 56.

First, the wire terminal 20 pressure-bonded to the end of the wire 10 is inserted into the terminal chamber 47. Specifically, while the lance 46 is moved with the top wall 22*b* of the wire terminal 20 from the locking position to the unlocking position, the wire terminal 20 is inserted into the terminal chamber 47. When the wire terminal 20 is inserted up to a predetermined position, the stepped portion 22*a* of the wire terminal 20 engages with the locking portion 46*a* of the lance 46, so that the lance 46 elastically returns to an original position (the locking position). At that time, the wire terminal 20 fits with the electrical contact portion 32 of the joint terminal 30. Therefore, the wire terminal 20 is electrically connected to the joint terminal 30.

As described above, all of the wire terminals 20 are inserted into the terminal chambers 47, so that the wire terminals 20 are electrically connected to the joint terminal 30. Thereby, the wire terminals 20 are shorted to one another via the joint terminal 30 (a short-circuit process).

Next, the joint connector JC, in which the wire terminals 20 are engaged with the locking portions 46*a* of the lances 46 while all of the wire terminals 20 are shorted to one another, is fixed onto a peripheral surface of the main line 56 of the wire harness 100.

Specifically, the joint connector JC is fixed onto the peripheral surface of the wire harness main line 56, such that, of the external walls 49 of the connector housing 40, a side on which the lances 46 is formed (i.e., a side at the auxiliary wall 45) faces the peripheral surface of the wire harness main line 56. At that time, as shown in FIG. 1, the axial direction of the wires 10 corresponds to the axial direction of the wire harness main line 56, so that the twisting of the wires 10 that are lead from the wire harness main line 56 is prevented. In this state, the alignment direction of the electric contact portions 32 of the joint terminal 30 is orthogonal to the axial direction of each of the wires 10, thereby reducing the amount of the projection of the joint connector from the peripheral surface of the wire harness main line 56. Also, the size of the connector housing 40 is minimized and the projection amount of the joint connector JC is minimized. In addition, in this state, the first projection 43*b* project in the width direction of the wire harness main line 56, and the second projection 48 projects outside the wire harness main line 56.

Next, the tape 58 is wound around a region between the first projection 43*b* and the second projection 48, based on the first projection 43*b* and the second projection 48. With the tape 58, the joint connector JC is fixed onto the peripheral surface of the wire harness main line 56. At that time, the outer surfaces 46*b* of the lances 46, which are exposed outside, contact the wire harness main line 56, and thereby displacement of the lances 46 to the unlocking position is restricted (a joint connector fixing process).

As described above, in the wire harness 100, the amount of the projection of the joint connector JC from the wire harness main line 56 is reduced. In addition, the wire harness main line 56 restricts displacement of the lances 46 to the unlocking position, so that a locking force to lock each of the wire terminals 20 by these lances 46 is maintained. As described above, the distance between the first projection 43*b* and the second projection 48 is substantially the same as the width of the tape 58, so that the tape 58 can be easily wound based on the first projection 43*b* and the second projection 48. Further, the first projection 43*b* and the second projection 48 prevent the tape 58 from shifting, so that the joint connector JC is securely fixed on the peripheral surface of the wire harness main line 56.

Figure 11:
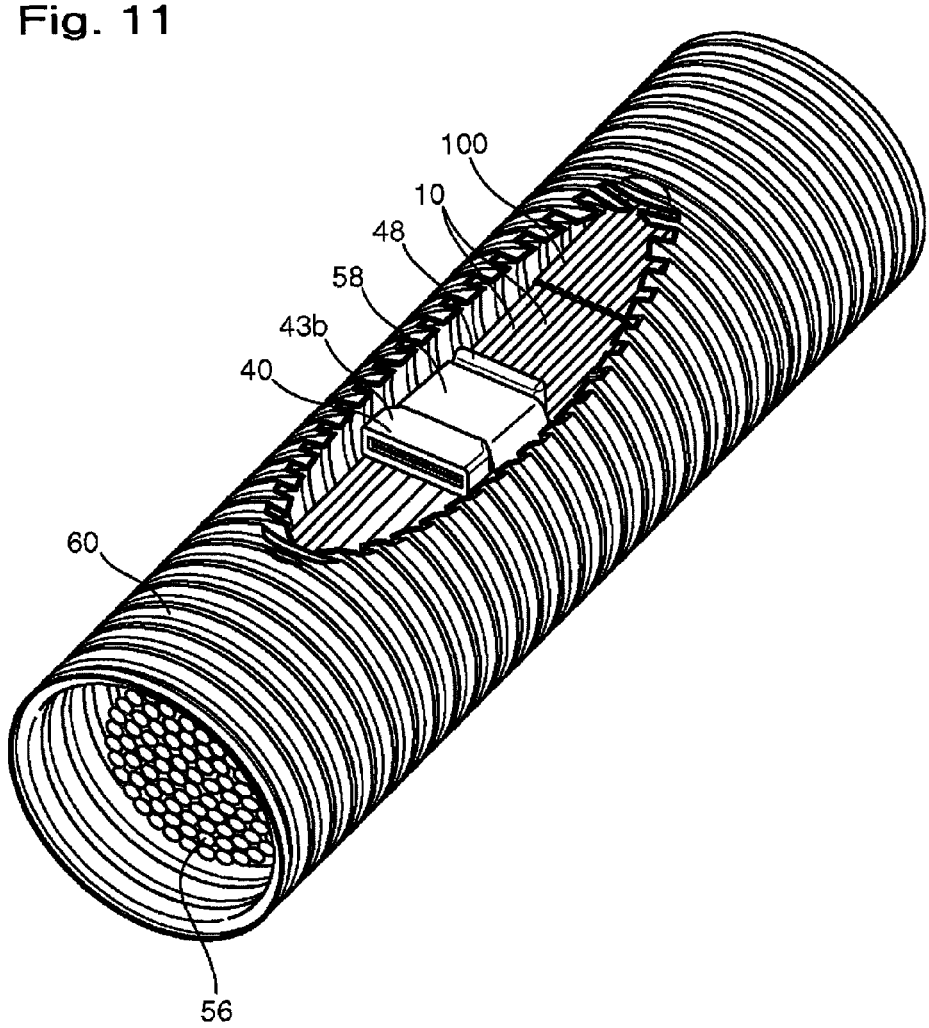
FIG. 11 is an illustrative view showing the wire harness of FIG. 1 housed inside a corrugated pipe.

Since the amount of the projection of the joint connector JC from the wire harness main line 56 is reduced as described above, as shown in FIG. 11, the wire harness 100 can be easily stored in a corrugated pipe (a protective pipe) 60. The corrugated pipe 60 is a deflectable pipe that bends along the wire harness main line 56. FIG. 11 shows the inside of the corrugated pipe 60 through a cut out portion of the corrugated pipe 60. In practical use, the entire circumference of wire harness 100 is covered by corrugated pipe 60.

When the wire harness main line 56 is housed inside the corrugated pipe 60 while the joint connector JC is fixed onto the periphery surface as described above, damages to the wire harness main line 56, impacts on the joint connector JC, the disengagement of the wire terminals 20 from the joint connector JC, and the like are prevented.

Figure 12:
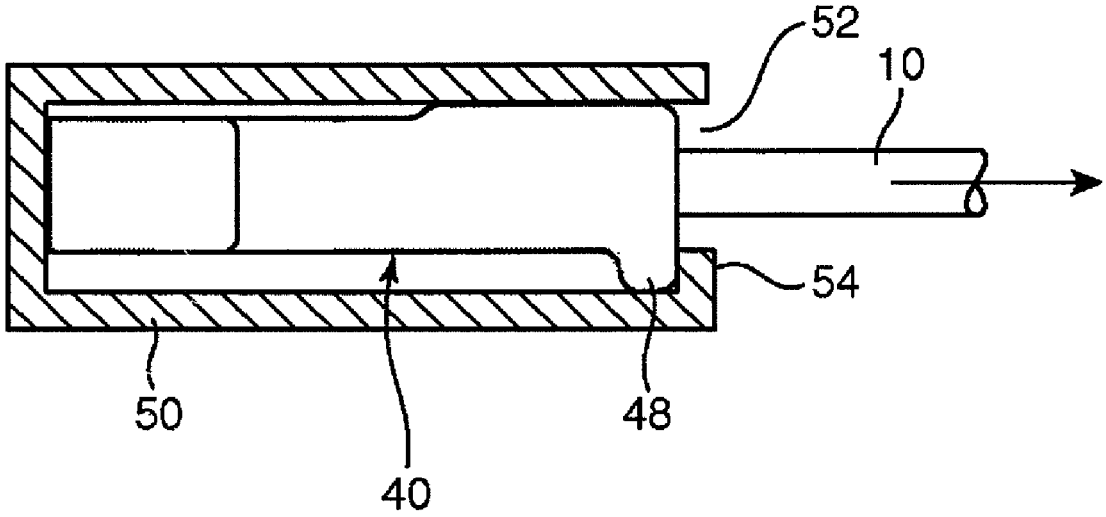
FIG. 12 is a cross-sectional view showing the joint connector of FIG. 1 stored in a tensile test jig.

The second projection 48 may be held by a jig when a tensile test is conducted on the wires 10 connected to the joint connector JC. An exemplary tensile test jig is shown in FIG. 12. A jig 50 shown in FIG. 12 has a container-like shape that can store the entire joint connector JC. In addition, the jig 50 has a window 52 to lead the wires 10 connected to the joint connector JC to the outside of the jig 50. Further, a circumferential portion of the window 52 is provided with a contact wall 54 that can contact the second projection 48 from outside.

The tensile test is performed by adding a tensile load to the wire 10 while the joint connector JC is stored in the jig 50 and the second projection 48 and the contact wall 54 are in contact. In this tensile test, since the second projection 48 abuts the contact wall 54, the joint connector JC is prevented from disengaging from the jig 50, thereby enabling an appropriate tensile load to be added to the wire 10 connected to the joint connector JC.

The first projection 43*b* and the second projection 48 may be omitted. However, the first projection 43*b* and the second projection 48 enable easy winding of the tape 58 around the joint connector JC, and stabilize a position of the tape 58. In addition, as described above, a tensile test can be performed by holding the second projection 48.

A specific form of the first projection 43*b* is not limited to the above-described form. However, when the terminal holder 43 is configured to have a large width, and is provided with the first projection 43*b* at both ends in the width direction, holding power of the terminal holder 43 to hold the joint terminal 30 is maintained. In addition, other effects are also obtained, such that the tape 58 can be positioned without separately providing the first projection 43*b*.

The number of the shorted wires 10 is not limited to the above-described numbers.

As described above, the present invention provides a wire harness that includes a wire harness main body configured with a plurality of wires; and a joint connector electrically shorting a plurality of wire terminals to one another, each of the plurality of wire terminals being respectively provided at ends of the plurality of wires included in the wire harness main body. The joint connector has a joint terminal contacting each of the wire terminals, and thereby shorting the wire terminals to one another; and a connector housing internally housing and holding the joint terminal and each of the wire terminals respectively. The joint terminal configured to contact each of the wire terminals, integrally includes: a plurality of electrical contact portions aligned in a direction substantially orthogonal to an axial direction of the wires connected to the wire terminals; and a short-circuit portion extending in a direction of the alignment of the electrical contact portions, and continuing to each of the electrical contact portions. The connector housing has: an external wall surrounding a terminal chamber configured to house each of the wire terminals, and being exposed outside; and a plurality of terminal locking tabs integrally formed with the external wall, and each locking each of the wire terminals housed in the terminal chamber while maintaining contact with the joint terminal. Each of the terminal locking tabs is configured to deflect between a locking position that locks each of the wire terminals and an unlocking position that unlocks each of the wire terminals, by retracting outward of the external wall from the locking position. The joint connector is fixed onto a peripheral surface of the wire harness main body while an outer surface of the external wall of the connector housing faces and contacts the peripheral surface of the wire harness main body, the connector housing being provided with the terminal locking tabs.

According to the present wire harness, the joint connector is provided on the peripheral surface of the wire harness main body. When each of the wire terminals are connected to respective electrical contact portion of the joint terminal of the joint connector, the wire terminals of the plurality of wires included in the wire harness main body are shorted to one another, via the short-circuit portions connected to the electrical contact portions.

Especially, in the wire harness, the joint terminal is aligned in the direction substantially orthogonal to the axial direction of the wires. The thickness of the joint connector is reduced in the axial direction of the wires and in a direction orthogonal to the alignment direction of the joint terminal. The terminal locking tabs are integrally formed with the external wall of the connector housing that is exposed outside. Therefore, compared to when the terminal locking tabs are provided inside the terminal chambers surrounded by the external walls of the connector housing, as disclosed in Japanese Patent Laid-open Publication No. 2005-50794, the thickness of the joint connector, i.e., projection amount from the wire harness main body is reduced. Accordingly, it is possible to minimize the size of the wire harness.

In addition, the outer surface of the external wall on which the terminal locking tabs are formed faces and contacts the peripheral surface of the wire harness main body, thereby restricting the displacement of the terminal locking tabs by the wire harness main body. Therefore, a locking force of the terminal locking tabs that locks each of the wire terminals can be maintained with a simple structure, without adding another particular member.

Further, according to the present invention, it is preferable to include a tape for fixing the joint connector onto the peripheral surface the wire harness main body. The connector housing has a first projection and a second projection both projecting outward from side surfaces of the external walls, except for a side surface facing the peripheral surface of the wire harness main body. In addition, the first projection is spaced apart from the second projection with a distance substantially equivalent to a width of the tape. Further, the tape is wound around a region between the first projection and the second projection. The above-described configuration simplifies winding of the tape on the wire harness main body, which is based on the first projection and the second projection. In addition, the first and second projections prevent the tape from shifting and allow the joint connector to be securely fixed.

It is preferable, with respect to the external walls of the connector housing, that portions surrounding the short-circuit portion of the joint terminal be greater in dimension in a direction of the alignment of the electric contact portions than portions other than those surrounding the short-circuit portion; and the first projection be configured with the portions surrounding the short-circuit portion of the joint terminal. With the above-described configuration, the portion surrounding the short-circuit portion increases in width, thereby maintaining the strength that holds the short-circuit portion. In addition, another first projection does not have to be separately added.

Since the projection amount from the wire harness main body is reduced as described above, according to the present invention, it is possible to provide the wire harness that includes a deflectable corrugated pipe (protective pipe) being able to bend along the wire harness main body. The deflectable corrugated pipe (protective pipe) houses therein the wire harness main body and the joint connector fixed onto the peripheral surface of the wire harness main body.

Furthermore, the present invention provides an assembling method of a wire harness that includes: a short-circuit process in which a plurality of wire terminals are electrically shorted to one another through use of a joint connector, each of the plurality of wire terminals being provided to the plurality of wire terminals included in a wire harness main body; and a joint connector fixing process in which the joint connector is fixed onto an outer surface of the wire harness main body. The joint connector used to short the wire terminals to one another in the short-circuit process has: a joint terminal contacting each of the wire terminals, and thereby shorting the wire terminals to one another; and a connector housing holding the joint terminal and each of the wire terminals while housing the joint terminal and each of the wire terminals therein, respectively. The joint terminal configured to contact each of the wire terminals, integrally includes: a plurality of electrical contact portions aligned in a direction substantially orthogonal to an axial direction of the wires connected to the wire terminals; and a short-circuit portion extending in a direction of the alignment of the electrical contact portions, and connecting to each of the electrical contact portions. The connector housing has: an external wall surrounding a terminal chamber configured to house each of the wire terminals, and being exposed outside; and a plurality of terminal locking tabs integrally formed with the external wall, and each locking each of the wire terminals housed in the terminal chamber while maintaining contact with the joint terminal. Each of the terminal locking tabs is configured to deflect between a locking position that locks each of the wire terminals and an unlocking position that unlocks each of the wire terminals by retracting outward of the external wall from the locking position. In the short-circuit process, each of the wire terminals is inserted into the terminal chamber, and is locked by the terminal locking tab in a position in contact with the joint terminal, thereby shorting the wire terminals to one another. In the joint connector fixing process, after all of the wire terminals are inserted in the terminal chamber, and are locked by the terminal locking tabs, the joint connector is fixed onto a peripheral surface of the wire harness main body while an outer surface of the external wall of the connector housing faces and contacts the peripheral surface of the wire harness main body, the connector housing being provided with the terminal locking tabs.

According to the assembling method, in the short-circuit process, each of the wire terminals is locked by each of the terminal locking tabs, and the wire terminals are shorted to one another. Subsequently, in the joint connector fixing process, the joint connector is fixed onto the peripheral surface of the wire harness main body while the outer surface of the external wall of the connector housing faces and contacts the peripheral surface of the wire harness main body, the connector housing being provided with the terminal locking tabs. Therefore, the wire terminals can be securely shorted to one another. In addition, each of the wire terminals can be more securely locked by restricting displacement of each of the terminal locking tabs.

What is claimed is:

1. A wire harness comprising:

a wire harness main body configured with a plurality of wires; and a joint connector electrically shorting a plurality of wire terminals to one another, each of the plurality of wire terminals being respectively provided at ends of the plurality of wires included in the wire harness main body;

the joint connector comprising:

a joint terminal contacting each of the wire terminals, and thereby shorting the wire terminals to one another; and a connector housing internally housing and holding the joint terminal and each of the wire terminals respectively;

the joint terminal comprising:

a plurality of electrical contact portions aligned in a direction substantially orthogonal to an axial direction of the wires connected to the wire terminals; and a short-circuit portion extending in a direction of the alignment of the electrical contact portions, and being contiguous with each of the electrical contact portions;

the connector housing comprising:

an external wall surrounding a terminal chamber which is configured to house each of the wire terminals and is open to the outside; and a plurality of terminal locking tabs integrally formed with the external wall, and each locking a respective one of the wire terminals housed in the terminal chamber while maintaining contact with the joint terminal, each of the terminal locking tabs being configured to deflect between a locking position that locks each of the wire terminals and an unlocking position that unlocks each of the wire terminals, by retracting outwardly of the external wall from the locking position, wherein, the joint connector is fixed onto a peripheral surface of the wire harness main body while an outer surface of the external wall of the connector housing faces and contacts the peripheral surface of the wire harness main body, the outer surface of the external wall of the connector housing being provided with the terminal locking tabs.

2. The wire harness according to claim 1, further comprising:

a tape for fixing the joint connector onto the peripheral surface the wire harness main body, wherein, the connector housing comprises a first projection and a second projection both projecting outwardly from side surfaces of the external wall, except for a side surface facing the peripheral surface of the wire harness main body, the first projection being spaced from the second projection by a distance substantially the same as a width of the tape; and wherein, the tape is wound around a region between the first projection and the second projection.

3. The wire harness according to claim 2, wherein, a portion of the external wall of the connector housing which surrounds the short-circuit portion of the joint terminal is greater in dimension in a direction of the alignment of the electric contact portions than other portions of the external wall; and the first projection is provided on the portion of the external wall surrounding the short-circuit portion of the joint terminal.

4. The wire harness according to claim 1, further comprising:

a deflectable protective pipe capable of bending along the wire harness main body, wherein, the deflectable protective pipe houses therein the wire harness main body and the joint connector fixed onto the peripheral surface of the wire harness main body.

5. The wire harness according to claim 2, further comprising:

a deflectable protective pipe capable of bending along the wire harness main body, wherein, the deflectable protective pipe houses therein the wire harness main body and the joint connector fixed onto the peripheral surface of the wire harness main body.

6. The wire harness according to claim 3, further comprising:

a deflectable protective pipe capable of bending along the wire harness main body, wherein, the deflectable protective pipe houses therein the wire harness main body and the joint connector fixed onto the peripheral surface of the wire harness main body.

7. An assembling method of a wire harness comprising:

a short-circuit process in which a plurality of wire terminals are electrically shorted to one another through use of a joint connector, each of the plurality of wire terminals being provided to the plurality of wire terminals included in a wire harness main body; and a joint connector fixing process in which the joint connector is fixed onto an outer surface of the wire harness main body, wherein, the joint connector used to short the wire terminals to one another in the short-circuit process comprises: a joint terminal contacting each of the wire terminals, and thereby shorting the wire terminals to one another; and a connector housing holding the joint terminal and each of the wire terminals while housing the joint terminal and each of the wire terminals therein, respectively, wherein, the joint terminal comprises: a plurality of electrical contact portions aligned in a direction substantially orthogonal to an axial direction of the wires connected to the wire terminals; and a short-circuit portion extending in a direction of the alignment of the electrical contact portions, and connecting to each of the electrical contact portions;

wherein, the connector housing comprises: an external wall surrounding a terminal chamber which is configured to house each of the wire terminals and is open to the outside; and a plurality of terminal locking tabs integrally formed with the external wall, and each locking a respective one of the wire terminals housed in the terminal chamber while maintaining contact with the joint terminal, each of the terminal locking tabs being configured to deflect between a locking position that locks each of the wire terminals and an unlocking position that unlocks each of the wire terminals by retracting outwardly of the external wall from the locking position, wherein, in the short-circuit process, each of the wire terminals is inserted into the terminal chamber, and is locked by the respective terminal locking tab in a position in contact with the joint terminal, thereby shorting the wire terminals to one another, wherein, in the joint connector fixing process, after all of the wire terminals are inserted in the terminal chamber, and are locked by the terminal locking tabs, the joint connector is fixed onto a peripheral surface of the wire harness main body while an outer surface of the external wall of the connector housing faces and contacts the peripheral surface of the wire harness main body, the outer surface of the external wall of the connector housing being provided with the terminal locking tabs.

* * * * *